US006746296B1

(12) United States Patent
Lin

(10) Patent No.: US 6,746,296 B1
(45) Date of Patent: Jun. 8, 2004

(54) BUBBLE BLOWER AND PENHOLDER ARRANGEMENT

(76) Inventor: Mon-Sheng Lin, 5th Floor, No. 4, Lane 7, Pao Kao Road, Hsintien, Taipei Hsien (TW)

( * ) Notice: Subject to any disclaimer, the term of this patent is extended or adjusted under 35 U.S.C. 154(b) by 0 days.

(21) Appl. No.: 10/395,075

(22) Filed: Mar. 25, 2003

(51) Int. Cl.[7] ..... A63H 33/28; B43K 29/00
(52) U.S. Cl. ..... 446/16; 446/267; 401/195
(58) Field of Search ..... 446/16–74, 267, 446/15; 401/195, 52, 17

(56) References Cited

U.S. PATENT DOCUMENTS 2,323,302 A * 7/1943 Block ..... 401/128
5,839,936 A * 11/1998 Lin ..... 446/16
6,132,125 A * 10/2000 Lin ..... 446/16
6,386,935 B1 * 5/2002 Lin ..... 446/16
6,422,974 B1 * 7/2002 Schimmel ..... 446/15

* cited by examiner

*Primary Examiner*—Derris H. Banks
*Assistant Examiner*—Faye Francis
(74) *Attorney, Agent, or Firm*—Troxell Law Office PLLC

(57) ABSTRACT

A bubble blower and penholder arrangement is disclosed to include a penholder holding a writing element, and a bubble blower mounted in the penholder for pressing by hand to extend the writing element out of the penholder for writing. The bubble blower includes a fluid container, which has a bottom extension tube inserted into the penholder and stopped at the top end of the writing element, and an applicator detachably fastened to the fluid container for picking up the bubble fluid for blowing bubbles.

3 Claims, 6 Drawing Sheets

BUBBLE BLOWER AND PENHOLDER ARRANGEMENT

BACKGROUND OF THE INVENTION

1. Field of the Invention

The present invention relates bubble blowers and, more specifically, to the arrangement of a bubble blower and the penholder of a pen, in which the bubble blower can be pressed to drive the writing element of the pen out of the penholder for writing.

2. Description of the Related Art

A conventional bubble-blowing apparatus generally comprises a fluid container holding a bubble fluid, and an applicator for picking up the bubble fluid from the fluid container for blowing bubbles. There are also known pen-base bubble blowers. A pen-base bubble blower is generally comprised of a penholder holding a writing element for writing, and an applicator. The penholder has a top open chamber adapted to hold a bubble fluid. The applicator can be fastened to the penholder to close the top open chamber. Due to limited space, the top open chamber holds a limited amount of bubble fluid. According to this design, the applicator cannot be designed as pres means for pressing by the user to control the movement of the writing element of the pen between the writing position and the non-operative position.

SUMMARY OF THE INVENTION

The present invention has been accomplished under the circumstances in view. It is the main object of the present invention to provide A bubble blower and penholder arrangement comprising a penholder holding a writing element, and a bubble blower mounted in said penholder for pressing by hand to extend said writing element out of said penholder for writing, said bubble blower comprising a fluid container holding a bubble fluid, and an applicator insertable into said fluid container to pick up said bubble fluid for blowing bubbles, said fluid container having a top bottleneck through which said applicator is inserted into the inside of said fluid container to pick up said bubble fluid, and a bottom extension tube inserted into said penholder and stopped at a top end of said writing element in said penholder.

DETAILED DESCRIPTION OF THE PREFERRED EMBODIMENT

Figure 1:
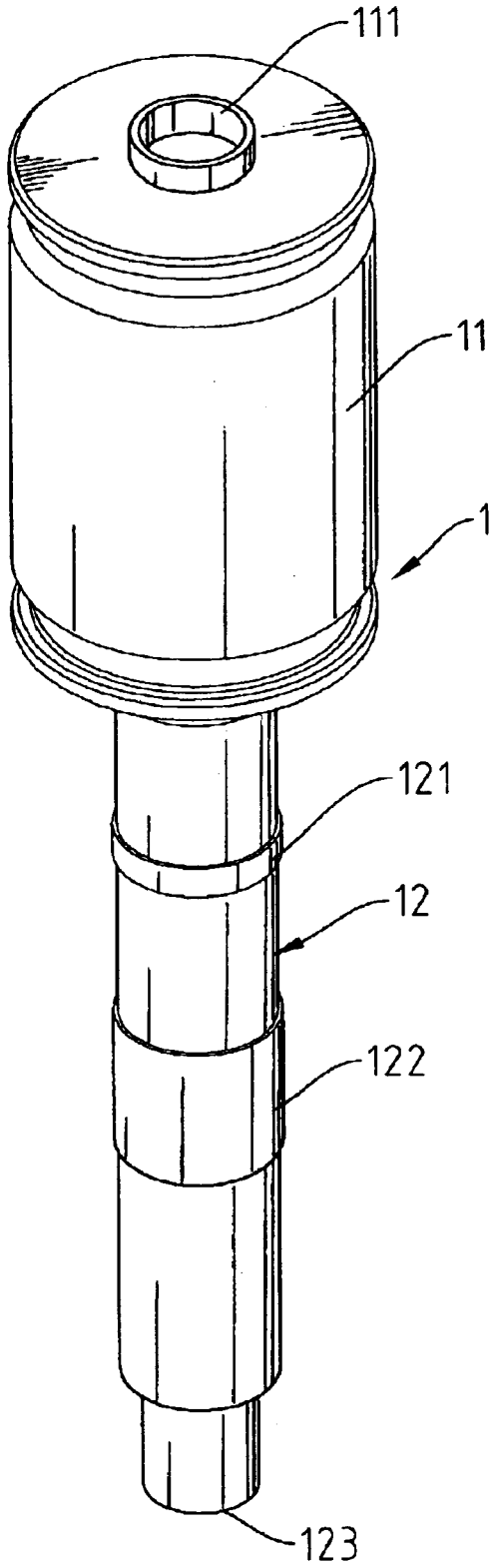
FIG. 1 is an elevational view of a bubble blower according to the present invention.
Figure 2:
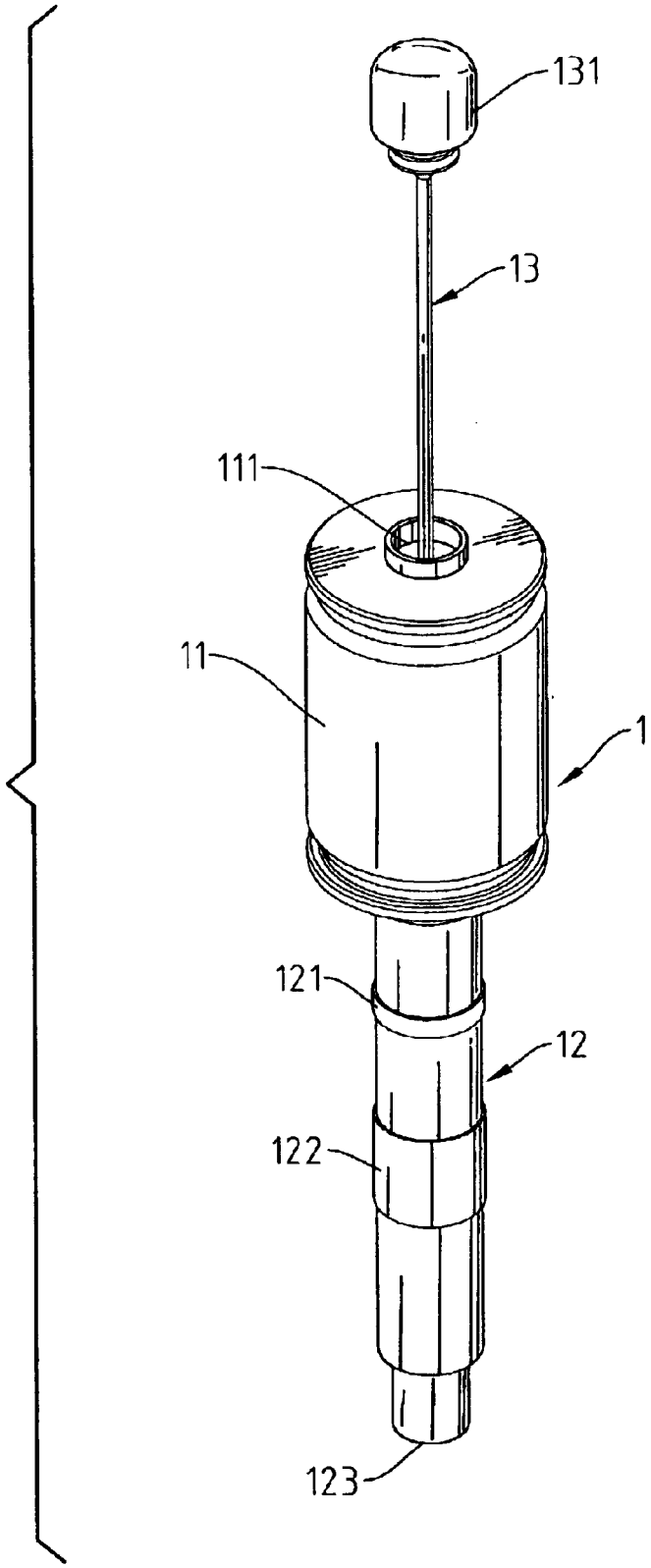
FIG. 2 is similar to FIG. 1 but showing the applicator lifted from the bottleneck of the fluid container.
Figure 3:
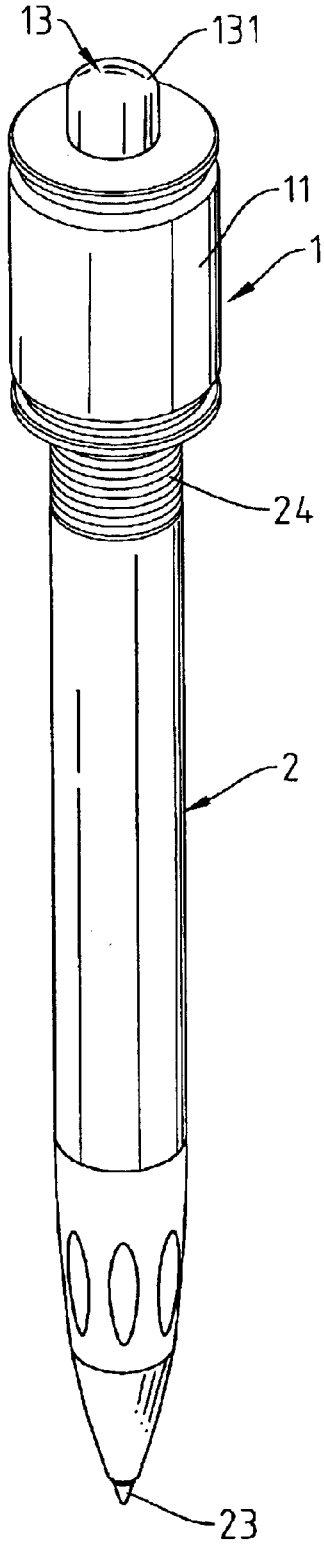
FIG. 3 is an elevational view of the present invention, showing the bubble blower installed in the penholder.

Referring to FIGS. 1~3, a bubble blower and penholder arrangement is shown comprised of a bubble blower 1, an axially compressible barrel 24, and a penholder 2. The bubble blower 1 comprises a fluid container 11, and an applicator 13. The fluid container 11 holds a bubble fluid for blowing bubbles, having a top bottleneck 111 and a bottom extension tube 12. The top end of the bottom extension tube 12 is an open end disposed in fluid communication with the inside space of the fluid container 11. The bottom end of the bottom extension tube 12 is a close end. The bottom extension tube 12 is inserted into the penholder 2. The applicator 13 can be inserted through the bottleneck 111 into the inside of the fluid container 1 to pick up the contained bubble fluid for blowing bubbles, having a handle 131 at the top end. The handle 131 fits the bottleneck 111 of the fluid container 11. When the applicator 13 inserted into the fluid container 11, the handle 131 can be forced into engagement with the bottleneck 111 to close the fluid container 11. The axially compressible barrel 24 is fixedly provided at the top side of the penholder 2, and adapted to, support the fluid container 11 above the penholder 2 upon insertion of the bottom extension tube 12 into the inside of the penholder 2. Further, the bottom extension tube 12 has a first outside annular flange 121 and a second outside annular flange 122 extended around the periphery at different elevations, and a bottom press tip 123. When the bubble blower 1 mounted in the penholder 2, the bottom press tip 123 is stopped at the top side of the writing element 23. Therefore, the user can press the bubble blower 1 to extend the writing element 23 to the outside of the penholder 2 for writing.

Figure 4:
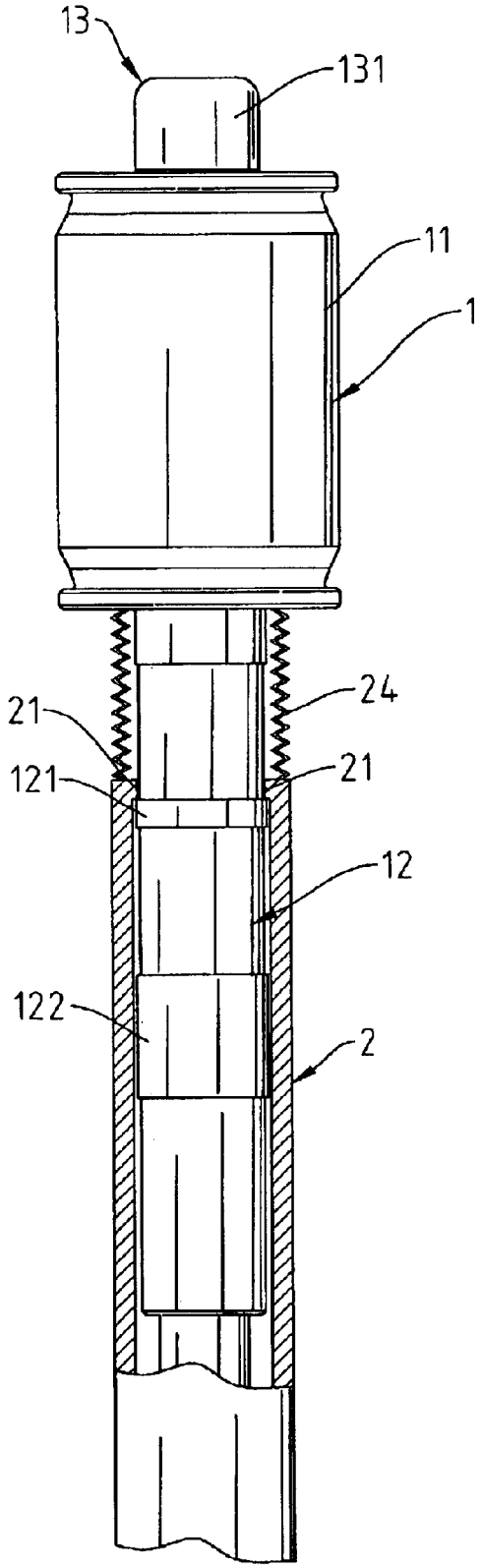
FIG. 4 is an enlarged view, partially in section, of a part of FIG. 3.

Referring to FIG. 4, the penholder 2 has an inside annular stop flange 21 extended around the inside wall near the top. The inner diameter of the inside annular stop flange 21 of the, penholder 2 is slightly smaller than the outer diameter of the outside annular flanges 121 and 122. After installation of the bubble blower 1 in the penholder 2, the outside annular flanges 121 and 122 of the bottom extension tube 12 are suspended below the inside annular stop flange 21 of the penholder 2. Therefore, the inside annular stop flange 21 of the penholder 2 holds the bottom extension tube 12 inside the penholder 2, and the axial movement of the bottom extension tube 12 in the penholder 2 is limited to a certain distance.

Figure 5:
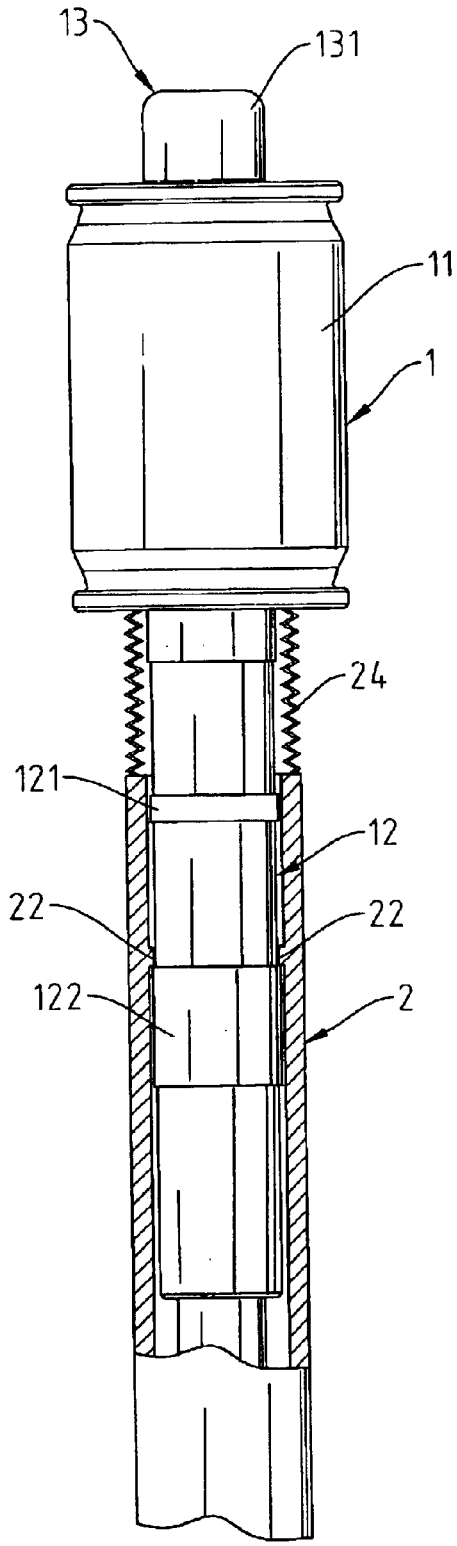
FIG. 5 is a sectional view of an alternate form of the present invention.

FIG. 5 shows an alternate form of the present invention. This embodiment is similar to the embodiment shown in FIG. 4 with the exception of the location of the inside annular stop flange of the penholder 2. According to this alternate form, the penholder 2 has an inside annular stop flange 22 extended around the inside wall and spaced from the top end at a distance. After installation of the bottom extension tube 12 in the penholder 2, the inside annular stop flange 22 is disposed between the outside annular flanges 121 and 122 of the bottom extension tube 12 to limit the axial movement of the bottom extension tube 12 to a certain distance.

Figure 6:
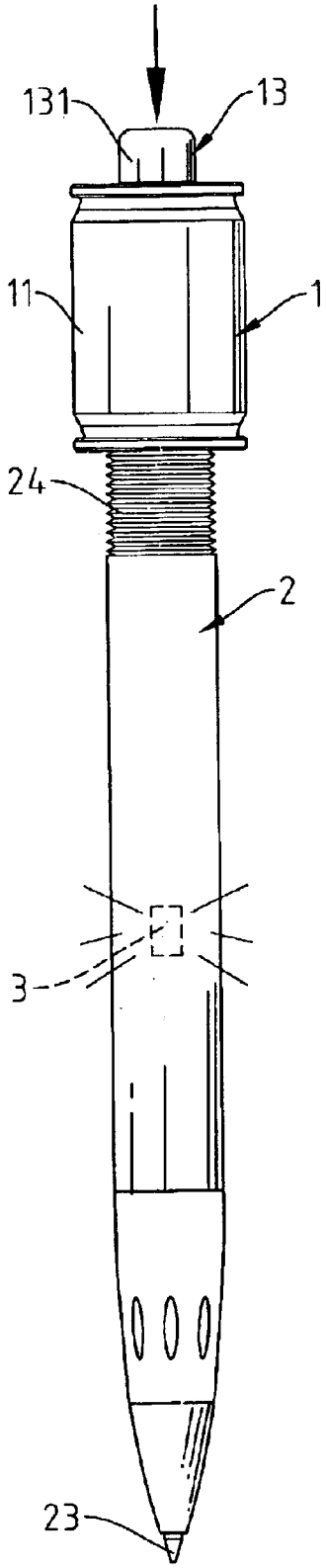
FIG. 6 is a schematic drawing of another alternate form of the present invention, showing the penholder equipped with a light-emitting device.

FIG. 6 shows another alternate form of the present invention. According to this alternate form, the penholder 2 is provided with a light-emitting device 3. When the user pressed the bubble blower 1 to extend out the writing element 23, the light-emitting device 3 is switched on to emit light.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A bubble blower and penholder arrangement comprising a penholder holding a writing element, and a bubble blower mounted in said penholder for pressing by hand to extend said writing element out of said penholder for writing, said bubble blower comprising a fluid container holding a bubble fluid, and an applicator insertable into said fluid container to pick up said bubble fluid for blowing bubbles, said fluid container having a top bottleneck through which said applicator is inserted into the inside of said fluid container to pick up said bubble fluid, and a bottom extension tube inserted into said penholder and stopped at a top end of said writing element in said penholder, wherein said penholder comprises an inside annular stop flange; said bottom extension tube of said fluid container has at least one outside annular flange suspended below the inside annular stop flange of said penholder, each of said at least one outside annular flange having an outer diameter greater than the inner diameter of said inside annular stop flange of said penholder.

2. The bubble blower and penholder arrangement as claimed in claim 1, wherein said penholder has an axially compressible barrel disposed at a top side thereof around said bottom extension tube and supporting said fluid container above said penholder.

3. The bubble blower and penholder arrangement as claimed in claim 1, wherein said bottom extension tube is suspended inside said penholder and movable with said fluid container in axial direction relative to said penholder.

* * * * *